US007895793B1

(12) United States Patent
Yates

(10) Patent No.: US 7,895,793 B1
(45) Date of Patent: Mar. 1, 2011

(54) DOWNSPOUT ASSEMBLY

(76) Inventor: Kenneth R. Yates, Boardman, OH (US)

( * ) Notice: Subject to any disclaimer, the term of this patent is extended or adjusted under 35 U.S.C. 154(b) by 0 days.

(21) Appl. No.: 12/509,472

(22) Filed: Jul. 26, 2009

(51) Int. Cl.
*E04D 13/00* (2006.01)
*E04D 13/08* (2006.01)

(52) U.S. Cl. ..... 52/12; 52/11; 52/16

(58) Field of Classification Search ..... 52/11, 12, 52/16; 210/162, 459, 474, 477
See application file for complete search history.

(56) References Cited

U.S. PATENT DOCUMENTS 543,922 A * 8/1895 Buckley ..... 210/249
608,765 A * 8/1898 Epple ..... 137/873
1,076,075 A * 10/1913 Steele ..... 210/447
1,653,473 A * 12/1927 Schulz ..... 210/130
2,887,073 A * 5/1959 Thompson ..... 52/16
4,523,875 A * 6/1985 DiFiore ..... 405/50
4,798,028 A * 1/1989 Pinion ..... 52/16
4,956,948 A * 9/1990 Hart ..... 52/16
5,114,594 A * 5/1992 Rosebrock et al. ..... 210/767
5,159,789 A * 11/1992 Haapanen ..... 52/16
5,406,756 A * 4/1995 Bemis et al. ..... 52/16
5,406,966 A * 4/1995 Lepkowski et al. ..... 134/104.4
5,526,612 A * 6/1996 Wade ..... 52/12
5,678,360 A * 10/1997 Fort et al. ..... 52/14
5,709,051 A * 1/1998 Mazziotti ..... 52/12
5,985,158 A * 11/1999 Tiderington ..... 210/767
6,024,127 A * 2/2000 Johnson ..... 137/873
6,076,307 A * 6/2000 Kean ..... 52/11
6,219,972 B1 * 4/2001 Zusy ..... 52/12
6,240,679 B1 * 6/2001 Smalara ..... 52/16
6,263,618 B1 * 7/2001 Jones ..... 52/12
6,497,816 B2 * 12/2002 Naddy ..... 210/162
6,647,670 B1 * 11/2003 Dran ..... 52/16
6,701,675 B1 * 3/2004 Ekker et al. ..... 52/16
6,827,103 B2 * 12/2004 Cheremshynski et al. ... 137/615
7,007,429 B2 * 3/2006 Kim ..... 52/16
7,096,627 B2 * 8/2006 Wade ..... 52/12
7,395,633 B2 * 7/2008 Baeta ..... 52/16
7,550,077 B2 * 6/2009 Graf ..... 210/162
2003/0051414 A1 * 3/2003 Bessette ..... 52/16
2005/0109693 A1 * 5/2005 Allard ..... 210/446

* cited by examiner

*Primary Examiner* — Richard E Chilcot, Jr.
*Assistant Examiner* — Mark R Wendell

(57) ABSTRACT

A downspout assembly includes a downspout, a downspout extension disposed in fluid communication with the downspout and a strainer basket seated in the downspout extension.

8 Claims, 4 Drawing Sheets

DOWNSPOUT ASSEMBLY

FIELD OF THE INVENTION

The present disclosure relates to downspouts for gutters. More particularly, the present disclosure relates to a downspout assembly which removes debris from water collected from a gutter.

BACKGROUND OF THE INVENTION

Downspouts are conduits which divert rainwater from a gutter on a building to the ground. However, due to their narrow design, many conventional downspouts may not be suitable for draining large volumes of rainwater from a gutter in heavy rain conditions. Moreover, conventional downspouts may have a tendency to become clogged with debris.

Therefore, a downspout assembly is needed which is capable of draining large volumes of rainwater from a gutter and removing debris from the rainwater.

SUMMARY OF THE INVENTION

The present disclosure is generally directed to a downspout assembly. An illustrative embodiment of the downspout assembly includes a downspout, a downspout extension disposed in fluid communication with the downspout and a strainer basket seated in the downspout extension.

BRIEF DESCRIPTION OF THE DRAWINGS

The disclosure will now be made, by way of example, with reference to the accompanying drawings, in which.

DETAILED DESCRIPTION

Figure 1:
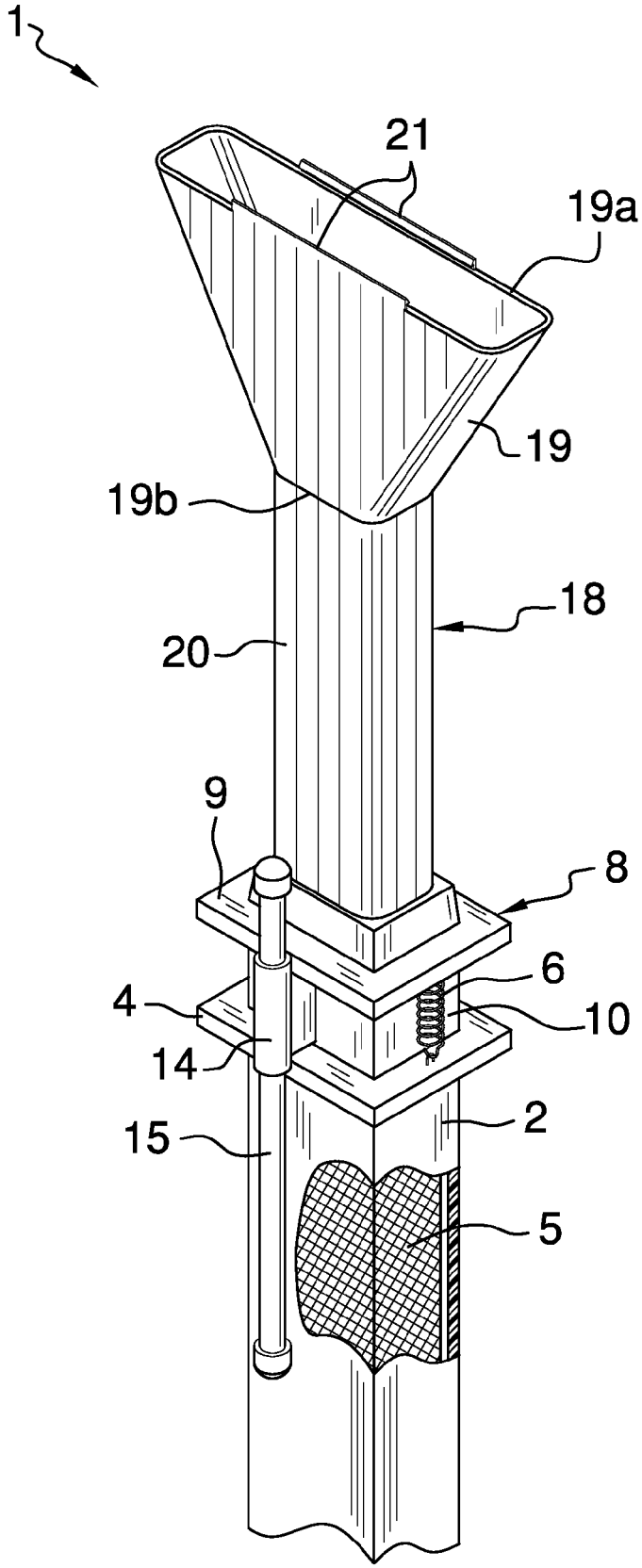
FIG. 1 is a perspective view, partially in section, of an illustrative embodiment of the downspout assembly.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

Referring to the drawings, an illustrative embodiment of the downspout assembly is generally indicated by reference numeral 1. The downspout assembly 1 includes a downspout 18 having a downspout funnel 19. The downspout funnel 19 has an inlet end 19*a* and an outlet end 19*b* which is spaced-apart from the inlet end 19*a*. In some embodiments, the inlet end 19*a* may be wider than the outlet end 19*b* of the downspout funnel 19 and the sides of the downspout funnel 19 may taper from the inlet end 19*a* to the outlet end 19*b*. Downspout attachment flanges 21 may be provided on the inlet end 19*a* of the downspout funnel 19 to facilitate attachment of the downspout funnel 19 to a gutter 24 (FIGS. 2-4) in fluid communication with a gutter opening 25 (FIG. 4) in the gutter 24. A generally elongated downspout conduit 20 may extend from the outlet end 19*b* of the downspout funnel 19. A downspout lid 8 may be provided on the downspout conduit 20 for purposes which will be hereinafter described. The downspout lid 8 may include a lid flange 9 which extends outwardly from the downspout conduit 20 and a lid sleeve 10 which extends from the lid flange 9 in surrounding relationship with respect to the downspout conduit 20. The downspout lid 8 may be capable of sliding vertically on the downspout conduit 20 of the downspout 18, as indicated by the dashed arrow in FIG. 3, for purposes which will be hereinafter described.

Figure 2:
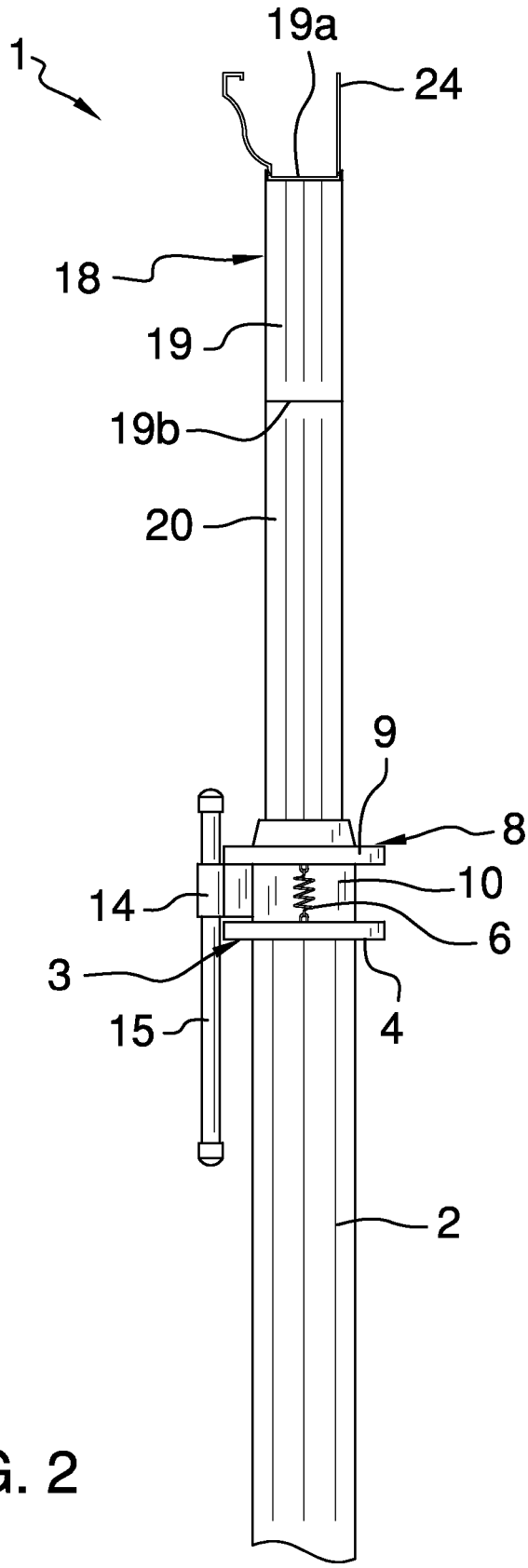
FIG. 2 is a side view of an illustrative embodiment of the downspout assembly.
Figure 3:
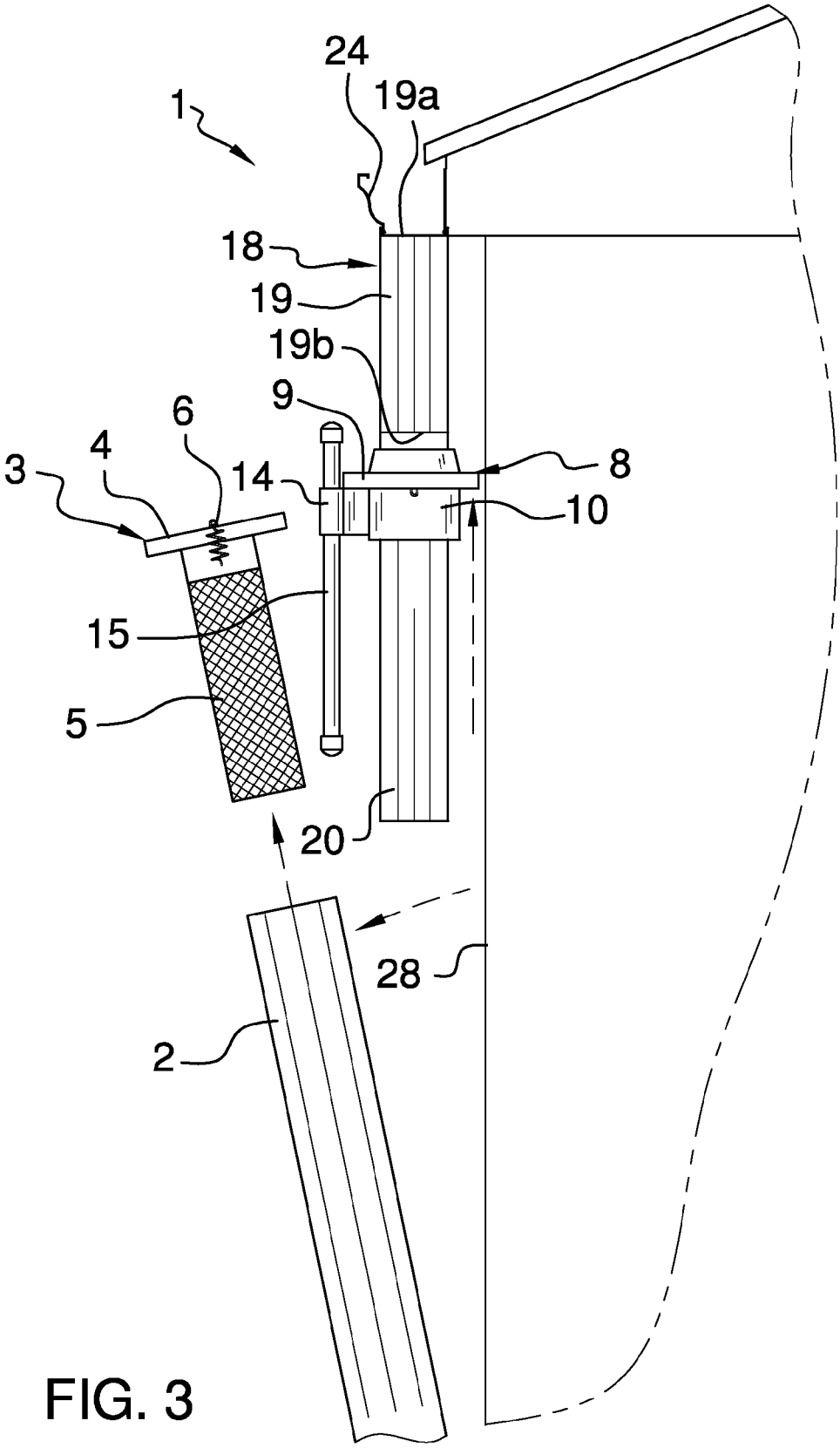
FIG. 3 is a side view of an illustrative embodiment of the downspout assembly, more particularly illustrating an exemplary technique for removing a strainer basket from the assembly.

A downspout extension 2 may be disposed in fluid communication with the downspout conduit 20 of the downspout 18. As shown in FIG. 3, in some embodiments the downspout extension 2 may be capable of pivoting into and out of the plane of the downspout conduit 20. A strainer basket 3 may be seated in the downspout extension 2. The strainer basket 3 may include a strainer basket flange 4 and a strainer mesh 5 which extends from the strainer basket flange 4. In some embodiments, multiple springs 6 may be selectively connected between the strainer basket flange 4 of the strainer basket 3 and the lid flange 9 of the downspout lid 8 to secure the downspout extension 2 within the plane of and in fluid communication with the downspout conduit 20. Other mechanisms known by those skilled in the art may be used to secure the downspout extension 2 within the plane of and in fluid communication with the downspout conduit 20. As shown in FIGS. 1-3, an indicator gauge 15 may be coupled to the strainer basket 3, such as via an indicator gauge mount bracket 14, to indicate when the strainer basket 3 is full of debris in operation of the downspout assembly 1, which will be hereinafter described.

Figure 4:
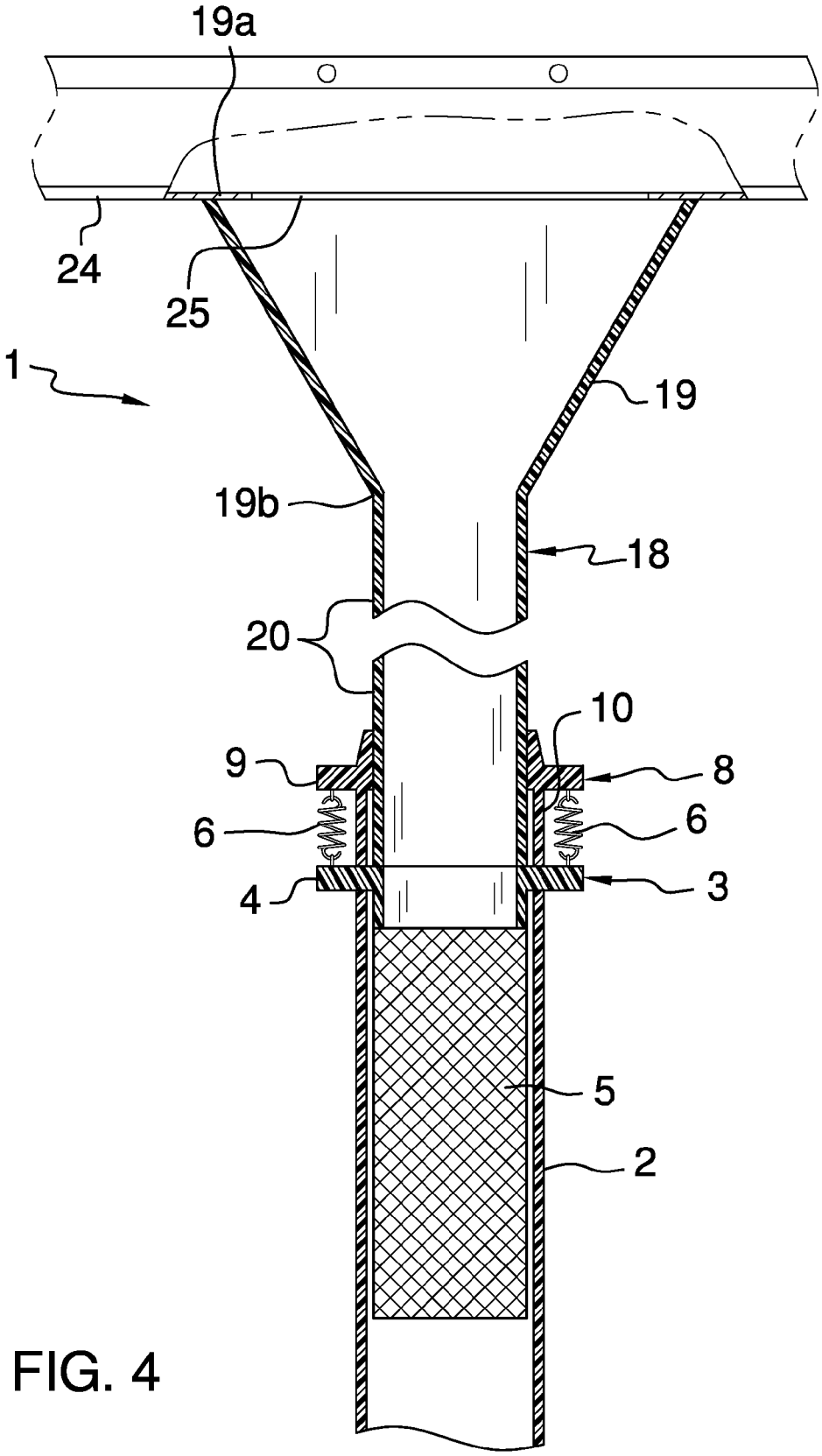
FIG. 4 is a longitudinal sectional view of an illustrative embodiment of the downspout assembly.

In typical use of the downspout assembly 1, the downspout funnel 19 of the downspout 18 is attached to a gutter 24 on a building 28 (FIG. 3) which may be a home or business, for example and without limitation. The downspout attachment flanges 21 (FIG. 1) provided on the inlet end 19*a* of the downspout funnel 19 may be used to attach the downspout funnel 19 to the gutter 24, with the inlet end 19*a* of the downspout funnel 19 disposed in fluid communication with a gutter opening 25 (FIG. 4) in the gutter 24. The strainer basket 3 is seated in the downspout extension 2 by pivoting the downspout extension 2 out of the plane of the downspout conduit 20, as shown in FIG. 3; seating the strainer basket 3 in the upper end of the downspout extension 2; and pivoting the downspout extension 2 back into the plane of the downspout conduit 20, respectively, such that the downspout extension 2 is disposed in fluid communication with the downspout conduit as shown in FIGS. 1, 2 and 4. The springs 6 may be attached between the strainer basket flange 4 of the strainer basket 3 and the lid flange 9 of the downspout lid 8, as shown in FIG. 2, to secure the downspout extension 2 in fluid communication with the downspout conduit 20.

During rainfall, rainwater (not shown) is collected in the gutter 24 and falls through the gutter opening 25 (FIG. 4) and into the downspout assembly 1. The rainwater flows first through the downspout funnel 19 and then through the downspout conduit 20 of the downspout 18, after which it flows through the strainer mesh 5 of the strainer 3 and is eventually discharged typically from the bottom of the downspout extension 2 onto the ground (not shown). Under heavy rain conditions, the wide inlet end 19*a* of the downspout funnel 19 facilitates flow of large volumes of water from the gutter 24 into the downspout assembly 1, preventing overflow of the gutter 24.

As the rainwater flows through the strainer basket 3, the strainer mesh 5 removes debris (not shown) such as sticks, leaves, pine straw and the like from the rainwater before the rainwater is discharged from the downspout extension 2 to prevent clogging of the downspout assembly 1 and overflow of the gutter 24. The indicator gauge 15 may indicate when the strainer basket 3 requires emptying or replacement. As shown in FIG. 3, the strainer basket 3 may be selectively removed from the downspout extension 2 for emptying or replacement purposes by detaching the springs 6 from the lid flange 9 of the downspout lid 8; sliding the downspout lid 8 upwardly on the funnel conduit 20, as indicated by the straight dashed arrow in FIG. 3; pivoting the downspout extension 2 out of the plane of the downspout conduit 20; removing the strainer basket 3 from the downspout extension 2; cleaning the strainer basket 3 or obtaining a replacement strainer basket 3; placing the cleaned or replacement strainer basket 3 in the downspout extension 2; pivoting the downspout extension 2 back into the plane of the downspout conduit 20; sliding the downspout lid 8 downwardly on the funnel conduit 20; and re-attaching the springs 6 to the lid flange 9 of the downspout lid 8.

While the embodiments of the disclosure have been described above, it will be recognized and understood that various modifications can be made and the appended claims are intended to cover all such modifications which may fall within the spirit and scope of the disclosure.

What is claimed is:

1. A downspout assembly, comprising:

a downspout;

a downspout extension disposed in fluid communication with said downspout;

a downspout funnel and a downspout conduit disposed in fluid communication with said downspout funnel and said downspout extension;

a downspout lid carried by said downspout conduit;

a strainer basket seated in said downspout extension; and an indicator gauge coupled to said strainer basket and adapted to indicate a state of fullness of said strainer basket.

2. The downspout assembly of claim 1 wherein said downspout funnel comprises an inlet end and an outlet end spaced-apart from and narrower than said inlet end and disposed in fluid communication with said downspout conduit.

3. The downspout assembly of claim 2 further comprising a plurality of downspout attachment flanges provided at said inlet end of said downspout funnel.

4. The downspout assembly of claim 1 further comprising at least one spring connecting said downspout lid and said strainer basket.

5. The downspout assembly of claim 1 wherein said downspout lid is slidably carried by said downspout conduit.

6. The downspout assembly of claim 1 wherein said downspout extension is pivotal into and out of a plane of said downspout conduit.

7. A downspout assembly, comprising:

a downspout having a downspout funnel including an inlet end and an outlet end spaced-apart from and narrower than said inlet end and an elongated downspout conduit extending from said outlet end;

a downspout lid having a lid sleeve slidably carried by said downspout conduit of said downspout and a lid flange carried by said lid sleeve;

a downspout extension disposed in fluid communication with said downspout conduit of said downspout and pivotal into and out of a plane of said downspout conduit;

a strainer basket having a strainer basket flange seated on said downspout extension and a strainer mesh carried by said strainer basket flange and disposed in said downspout extension;

a plurality of springs connecting said lid flange of said downspout lid and said strainer basket flange of said strainer basket; and an indicator gauge coupled to said strainer basket and adapted to indicate a state of fullness of said strainer basket.

8. The downspout assembly of claim 7 further comprising a plurality of downspout attachment flanges provided at said inlet end of said downspout funnel of said downspout.

* * * * *